US006295251B1

(12) United States Patent
Sakai et al.

(10) Patent No.: US 6,295,251 B1
(45) Date of Patent: Sep. 25, 2001

(54) TIMEPIECE DIAL PLATE AND TIMEPIECE DIAL PLATE MANUFACTURING METHOD

(75) Inventors: Shigeo Sakai; Katsuhiko Ishiguro, both of Chuo-ku; Masami Matsuzaki, Warabi, all of (JP)

(73) Assignee: Seiko Kabushiki Kaisha, Tokyo-to (JP)

( * ) Notice: Subject to any disclaimer, the term of this patent is extended or adjusted under 35 U.S.C. 154(b) by 0 days.

(21) Appl. No.: 09/352,547

(22) Filed: Jul. 12, 1999

(30) Foreign Application Priority Data

Apr. 23, 1999 (JP) ..... 11-116529

(51) Int. Cl.[7] ..... G04B 19/06
(52) U.S. Cl. ..... 368/232
(58) Field of Search ..... 368/232, 228, 368/276, 236, 314

(56) References Cited

U.S. PATENT DOCUMENTS 3,786,627 * 1/1974 Takagi et al. ..... 368/232
3,793,824 * 2/1974 Simon-Vermot et al. ..... 368/232
4,583,866 * 4/1986 Kasai et al. ..... 368/232
4,711,586 * 12/1987 Kizawa ..... 368/232

* cited by examiner

*Primary Examiner*—Bernard Roskoski
(74) *Attorney, Agent, or Firm*—Stroock & Stroock & Lavan LLP

(57) ABSTRACT

A timepiece dial plate comprises an upper plate (1) provided with holes (2, 4) and positioning legs (3) projecting from its lower surface so as to position the upper plate (1) relative to a movement; and a lower plate (11) provided on its upper surface with solid indices (12) to be fitted in the holes (2) of the upper plate (1) so as to protrude from an upper surface of the upper plate (1), and provided with holes (13) through which the positioning legs (3) of the upper plate (1) are extended. The upper plate (1) and the lower plate (11) are superposed so that the solid indices (12) of the lower plate (11) are fitted in the holes (2) of the upper plate (1), respectively, and protrude from the upper surface of the upper plate (1), and the positioning legs (3) of the upper plate (1) extend through the holes (13) of the lower plate (11), respectively.

17 Claims, 7 Drawing Sheets

TIMEPIECE DIAL PLATE AND TIMEPIECE DIAL PLATE MANUFACTURING METHOD

BACKGROUND OF THE INVENTION

1. Field of the Invention

The present invention relates to a timepiece dial plate and, more particularly, to a timepiece dial plate provided on its face with relief indices resembling characters and such.

2. Description of the Related Art

Referring to FIG. 10, a timepiece dial plate 100 is provided on its face with indices including hour markers 102 and a name marker 103. The time piece dial plate 100 is fixedly provided with two positioning legs 101 so as to project from the back surface of the timepiece dial plate 100. The two positioning legs 101 position and fix in place the timepiece dial plate 100 relative to a movement. Various finishing methods are applied to the manufacture of luxury timepieces to finish their indices including hour markers beautifully. For example, a timepiece dial plate 100 as shown in FIG. 11 is provided with indices including hour markers 102 set on the face thereof by a setting method. The setting method forms hour markers 102 having various facets individually, and sets each of the hour markers 102 on a timepiece dial body by fitting legs 102*a* formed on the hour marker 102 in holes formed in the timepiece dial body of the timepiece dial plate 100. The indices thus attached to the timepiece dial plate 100 assume a fully solid appearance.

Those indices, however, need high manufacturing costs because the indices must individually be subjected to many processes to form the facets. Since the facets are limited to flat surfaces, the indices are unable to assume a solid appearance having optional curved surfaces.

An electroforming method is another method of manufacturing a timepiece dial plate provided with fully solid indices. An electroforming method deposits a metal on a pattern by electrodeposition and separates a metal coating formed over the pattern from the pattern to obtain an electroformed article having a shape exactly resembling that of the surface of the pattern. Electroforming is capable of forming facets of indices, such as hour markers, not only in flat surfaces but also in optional curved surfaces.

An electroforming process for forming a timepiece dial plate will be described with reference to FIG. 12 by way of example.

A model 110 (male pattern) as shown in FIG. 12(*a*) exactly resembling a timepiece dial plate to be manufactured is formed. In FIG. 12(*a*), indices including hour markers are represented typically by a protrusion 105. As shown in FIG. 12(*b*), a plastic mother 111 (female pattern) of a plastic material is formed by using the model 110. The plastic mother 111 is separated from the model 110 as shown in FIG. 12(*c*), and a plurality of stampers 112 (male patterns) are formed by depositing an alloy of Cu and Ni or the like on the plastic mother 111 by electroforming. Then, as shown in FIG. 12(*d*), a number of plastic patterns 113 (female patterns) equal to the number of timepiece dial plates to be produced are formed by using the stampers 112 (male patterns). A timepiece dial body 115 for a timepiece dial plate 116 as shown in FIG. 12(*f*) is formed by electroforming using the plastic pattern 113. An electroformed member 114 is formed by using the plastic pattern 113 as shown in FIG. 12(*e*). The electroformed molding is separated from the plastic pattern 113, and the electroformed member 114 is cut along a cutting plane 114a to obtain the timepiece dial body 115.

Legs 117 for fixedly positioning the timepiece dial plate 116 relative to a movement must be welded or brazed to the timepiece dial body 115. The electroformed member 114 must be cut along the cutting plane 114*a* to form the timepiece dial body 115 having a flat back surface and a thickness t. Then, the legs 117 are welded or brazed to the flat back surface of the timepiece dial body 115 to complete the timepiece dial plate 116.

When manufacturing the timepiece dial plate 116 by the conventional electroforming method, the timepiece dial body 115 formed by an electroforming process secures rigidity and strength for the timepiece dial plate 116, and the legs 117 are welded or brazed to the timepiece dial body 115. Therefore, the back surface of the timepiece dial body 115 must be flat to facilitate welding or brazing the legs 117 thereto, and the timepiece dial body 115 must be relatively thick. However, the electroforming process needs several days to form a layer of several tens micrometers in thickness. Therefore, the electroforming process must be continued for several days, which increases the manufacturing costs of the timepiece dial plate greatly.

SUMMARY OF THE INVENTION

Accordingly, it is an object of the present invention to solve those problems in the prior art and to provide a timepiece dial plate provided with indices having an excellent solidity and a luxurious appearance.

Another object of the present invention is to provide a method of manufacturing a timepiece dial plate provided with indices having an excellent solidity and a luxurious appearance.

According to a first aspect of the present invention, a timepiece dial plate comprises: an upper plate provided with holes, and positioning legs projecting from its lower surface so as to position the upper plate relative to a movement, and a lower plate provided on its upper surface with solid indices to be fitted in the holes of the upper plate so as to protrude from the upper surface of the upper plate and provided with holes through which the positioning legs of the upper plate are extended, in which the upper plate and the lower plate are superposed so that the solid indices of the lower plate are fitted in the holes of the upper plate, respectively, and protrude from the upper surface of the upper plate, and the positioning legs of the upper plate extend through the holes of the lower plate, respectively.

Preferably, the lower plate is formed by an electroforming method, the indices are formed integrally with a main part of the lower plate, the lower plate has a flat lower surface, the upper plate has a flat upper surface and a flat lower surface, parts of the lower surface of the lower plate corresponding to the indices are recessed, the thickness of the upper plate is greater than that of the main part of the lower plate, and the thickness of the upper plate is at least twice as great as that of the main part of the lower plate.

According to a second aspect of the present invention, a timepiece dial plate manufacturing method comprises the steps of: forming an upper plate provided with holes and positioning legs projecting from its lower surface to position the upper plate relative to a movement; forming a lower plate provided on its upper surface with solid indices to be fitted in the holes of the upper plate so as to protrude from the upper surface of the upper plate and provided with holes through which the positioning legs of the upper plate are extended; and superposing the upper plate and the lower plate so that the solid indices of the lower plate are fitted in the holes of upper plate, respectively, and protrude from the upper surface of the upper plate, and the positioning legs of the upper plate extend through the holes of the lower plate, respectively.

Preferably, the lower plate is formed by using a pattern having on it surface with protrusions corresponding to the indices and provided with holes corresponding to the holes through which the positioning legs are extended. Preferably, the lower plate is formed by an electroforming process using a pattern having on it surface with protrusions corresponding to the indices and provided with holes corresponding to the holes through which the positioning legs are extended. The indices are formed integrally with a main part of the lower plate. The lower plate has a flat lower surface, and the upper plate has a flat upper surface. Both the upper and the lower surface of the upper plate are flat. Regions of the lower surface of the lower plate corresponding to the indices are recessed, the thickness of the upper plate is greater than that of the main part of the lower plate, and the thickness of the upper plate is at least twice as great as that of the main part of the lower plate.

According to the present invention, the timepiece dial plate comprises the upper plate and the lower plate, the indices having surfaces of complicated shapes are formed in the lower plate, the positioning legs are attached to the upper plate, and the functionally necessary rigidity and strength of the timepiece dial plate are secured by the upper plate. Therefore, the upper and the lower plate can be manufactured without difficulty, and the indices respectively having surfaces of optional, complicated shapes and fully luxurious appearance can easily be formed.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
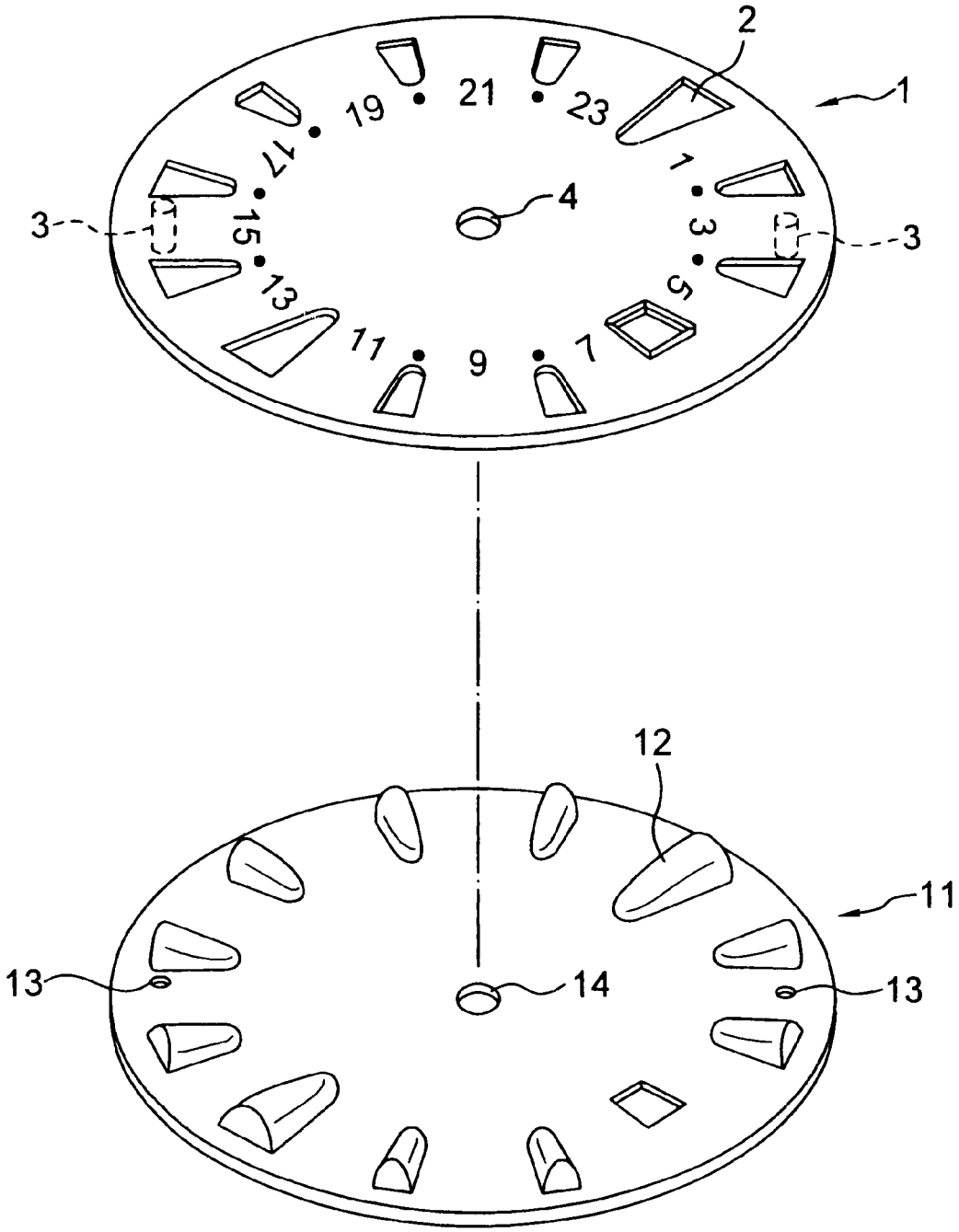
FIG. 1 is an exploded perspective view of a timepiece dial plate in a preferred embodiment according to the present invention.

Referring to FIG. 1, a timepiece dial plate in a preferred embodiment according to the present invention comprises an upper plate 1 having the shape of a flat disk, and a lower plate 11 having the shape of a flat disk. The lower plate 11 is joined to the lower surface of the upper plate 1.

Figure 2:
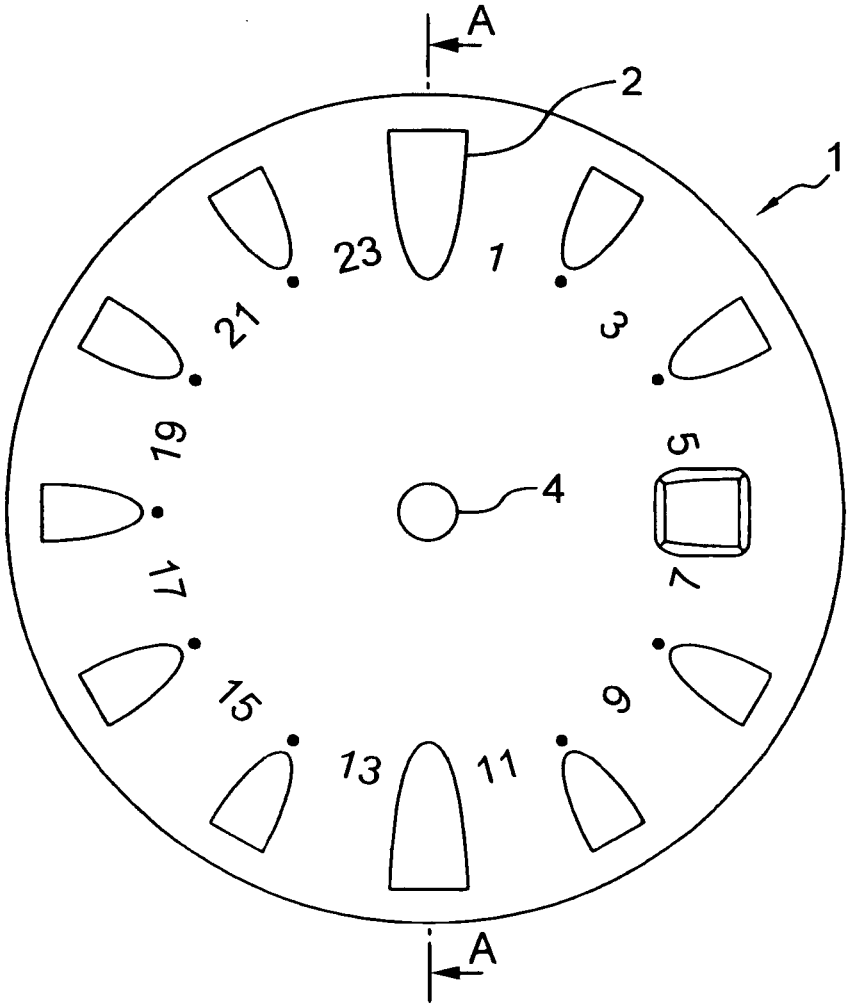
FIG. 2 is a plan view of an upper plate.
Figure 3:
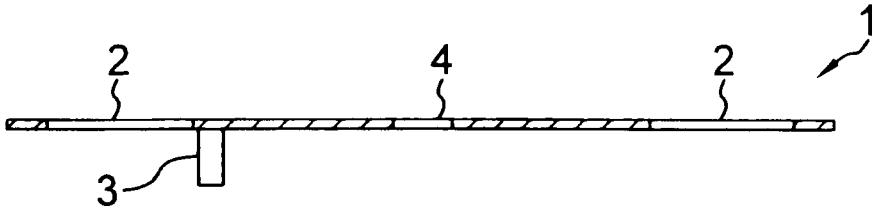
FIG. 3 is a sectional view taken on line A—A in FIG. 2.

Referring to FIGS. 2 and 3, the upper plate 1 is provided with twelve holes 2 for receiving solid hour markers 12 therein so that the solid hour markers 12 protrude from the upper surface of the upper plate 1. A center hole 4 is formed in a central part of the upper plate 1. Two positioning legs 13 for positioning the timepiece dial plate relative to a movement are welded or brazed to the flat lower surface of the upper plate 1 so as to extend perpendicularly to the lower surface.

Figure 4:
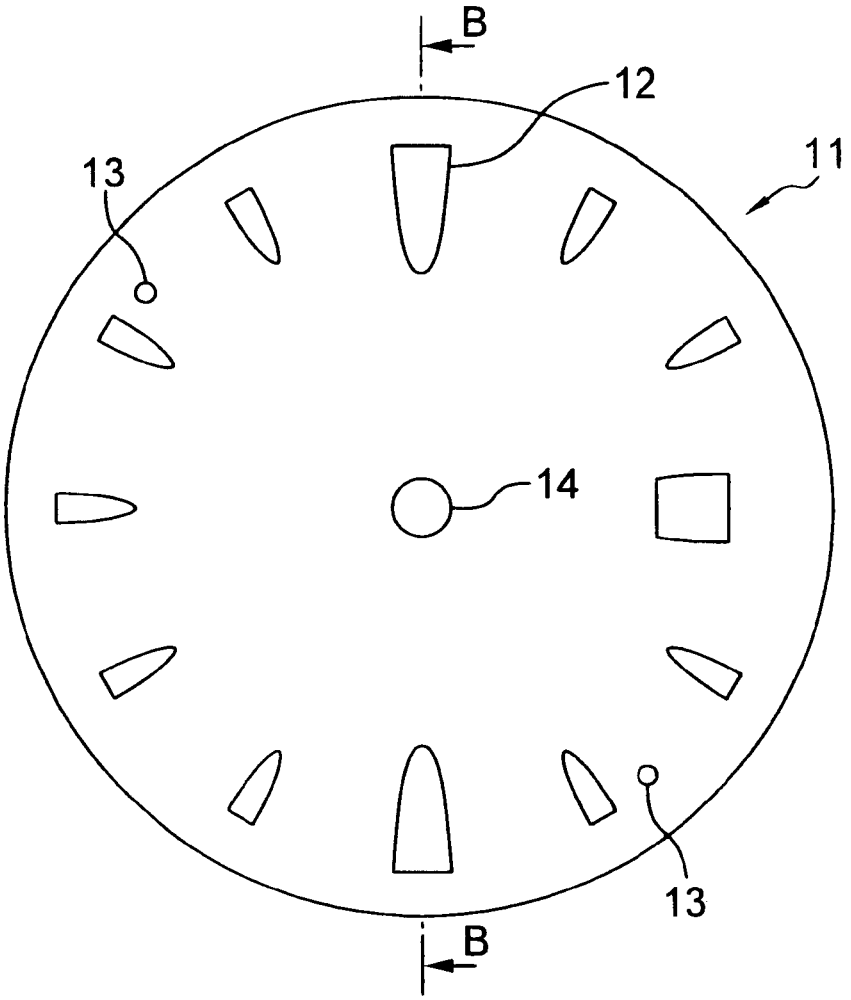
FIG. 4 is a plan view of a lower plate.
Figure 5:
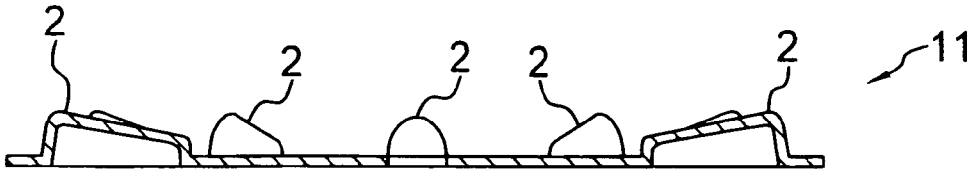
FIG. 5 is a sectional view taken on line B—B in FIG. 4.

Referring to FIGS. 4 and 5, the twelve solid hour marks 12 are arranged on and protrude from the upper surface of the lower plate 11. The lower plate 11 is provided with two holes 13 through which the two positioning legs 3 are extended, respectively. The lower plate 11 is provided with a center hole 14 at a position corresponding to that of the center hole 4 of the upper plate 1.

Figure 6:
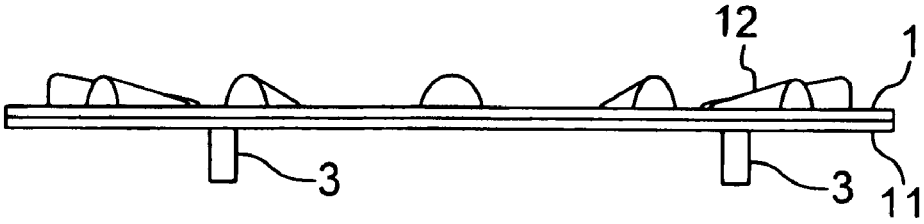
FIG. 6 is a side elevation of the timepiece dial plate shown in FIG. 1.
Figure 7:
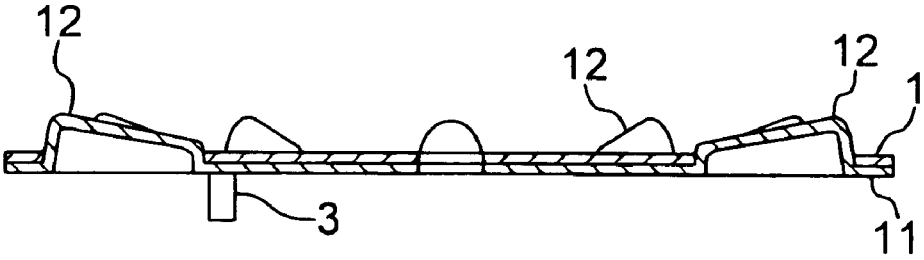
FIG. 7 is a sectional view of the timepiece dial plate shown in FIG. 1.
Figure 8:
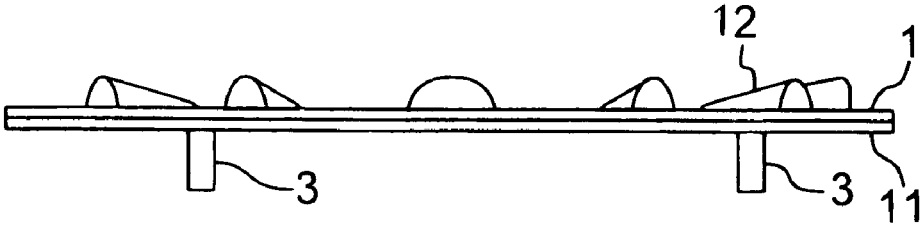
FIG. 8 is a side elevation of the timepiece dial plate shown in FIG. 1.

As shown in FIGS. 1, 6, 7 and 8, the upper plate 1 and the lower plate 11 are superposed with the hour markers 12 fitted in the holes 2 and the positioning legs 3 extended through the holes 13, and the upper plate 1 and the lower plate 11 are fixedly bonded together with an adhesive. FIG. 6 is a side elevation of the timepiece dial plate formed by superposing the upper plate 1 and the lower plate 11 as viewed from the right side of the timepiece dial plate, FIG. 7 is a sectional view of the timepiece dial plate and FIG. 8 is a side elevation of the timepiece dial plate as viewed from the left side of the timepiece dial plate.

The lower plate 11 is formed of an alloy, such as an alloy of Cu and Ni, by an electroforming method. As shown in FIG. 1, each of the solid hour markers 12 of the lower plate 11 has a three-dimensionally curved surface of a shape formed by combining various kinds of ellipsoids. As shown in FIG. 7, the hour markers 12 are formed integrally with the body of the lower plate 11. The body of the lower plate and the hour markers 12 are substantially the same in thickness and hence the hour markers 12 are hollow and the back surfaces of the same are concave. Since the positioning legs 3 need not be welded to the lower plate 11, the body of the lower plate 11 need not be formed in a great thickness to secure sufficient rigidity and strength. The sufficient thickness of the lower plate 11 is, for example, 100 $\mu$m. The lower plate 11 does not secure rigidity and strength for the timepiece dial plate. A principal purpose of the lower plate 11 is to provide the solid hour markers 12 having surfaces of complicated shapes for the timepiece dial plate.

The upper plate 1 is manufactured by pressing a Bs plate, and the holes 2 for the hour markers 12 and the hole 4 for the hour and the minute shaft of a movement are formed by punching. The thickness of the upper plate 1 is at least twice as great as that of the lower plate 11. The thickness of the upper plate 1 is, for example, 250 $\mu$m. The rigidity and strength of the timepiece dial plate of the present invention are secured mostly by the upper plate 1. The upper and the lower surface of the upper plate 1 are flat. The positioning legs 3 are welded to the upper plate 1 at predetermined positions on the lower surface of the same..

Figure 9:
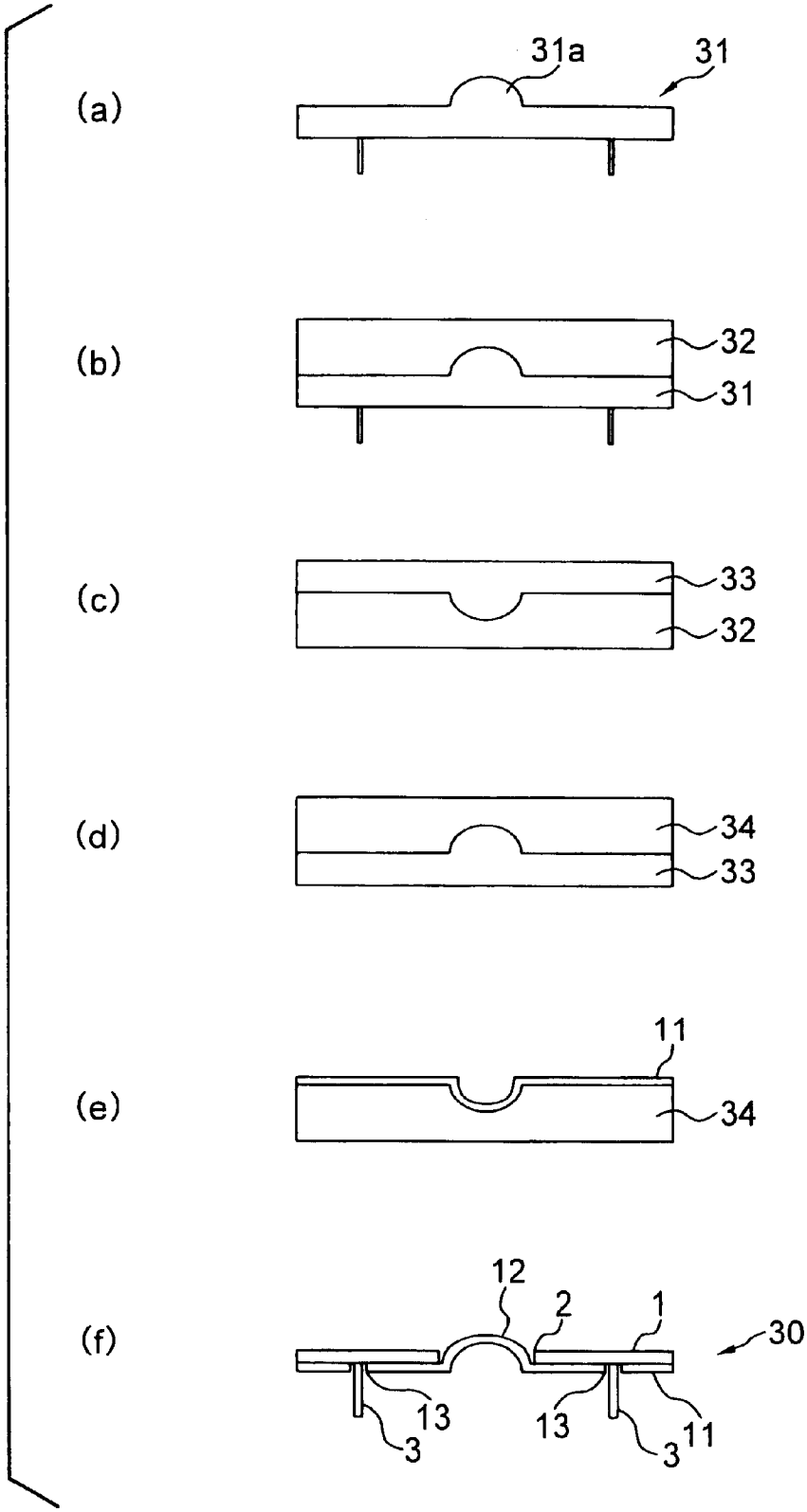
FIGS. 9(*a*) to 9(*f*) are views of assistance in explaining a timepiece dial plate manufacturing method in accordance with the present invention.
Figure 10:
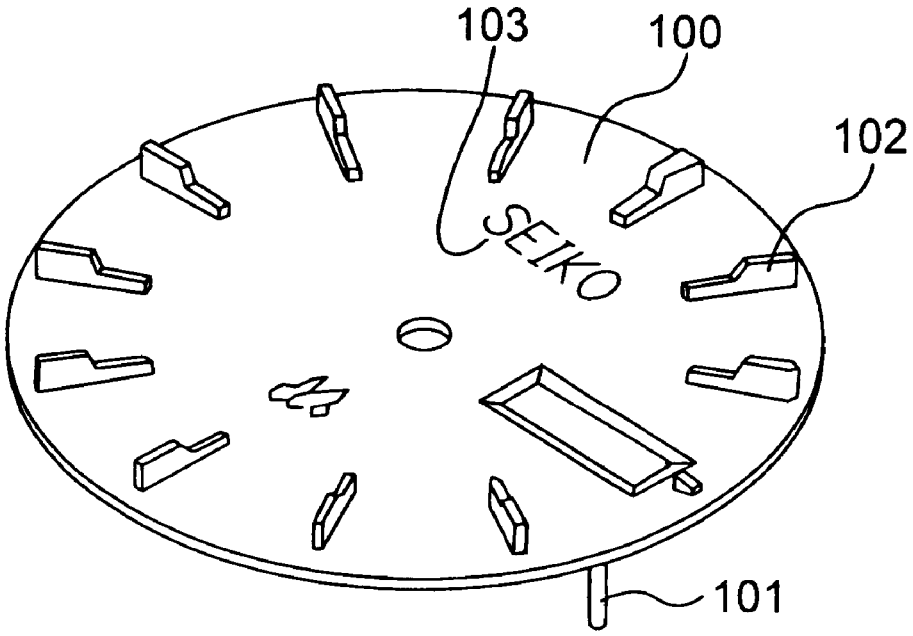
FIG. 10 is a perspective view of a general timepiece dial plate.
Figure 11:
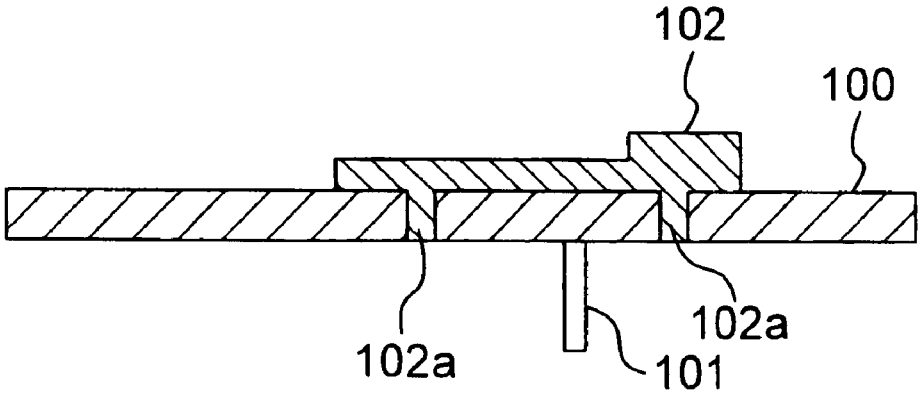
FIG. 11 is a sectional view of a timepiece dial plate provided with indices set in place by a setting method.

A method of manufacturing the lower plate 11 will be described hereinafter. Referring to FIG. 9(*a*), one original pattern (male pattern) 31 is modeled on a timepiece dial plate to be manufactured. In FIG. 9(*a*), a protruding index 31a typically represents indices including hour markers 12. As shown in FIG. 9(*b*), A plastic mother (female pattern) 32 of a plastic material is formed on the original pattern 31. Then, as shown in FIG. 9(*c*), the plastic mother 32 is separated from the original pattern 31, and a plurality of stampers (male patterns) 33 of an alloy, such as an alloy of Cu and Ni, are formed by electroforming using the plastic mother 32. Each stamper 33 separated from the plastic mother 32. Plastic patterns (female patterns) 34 of, for example, a plastic material are mass-produced by using the stampers 33 as shown in FIG. 9(*d*). The number of the plastic patterns 34 is equal to that of timepiece dial plates to be manufactured.

Figure 12:
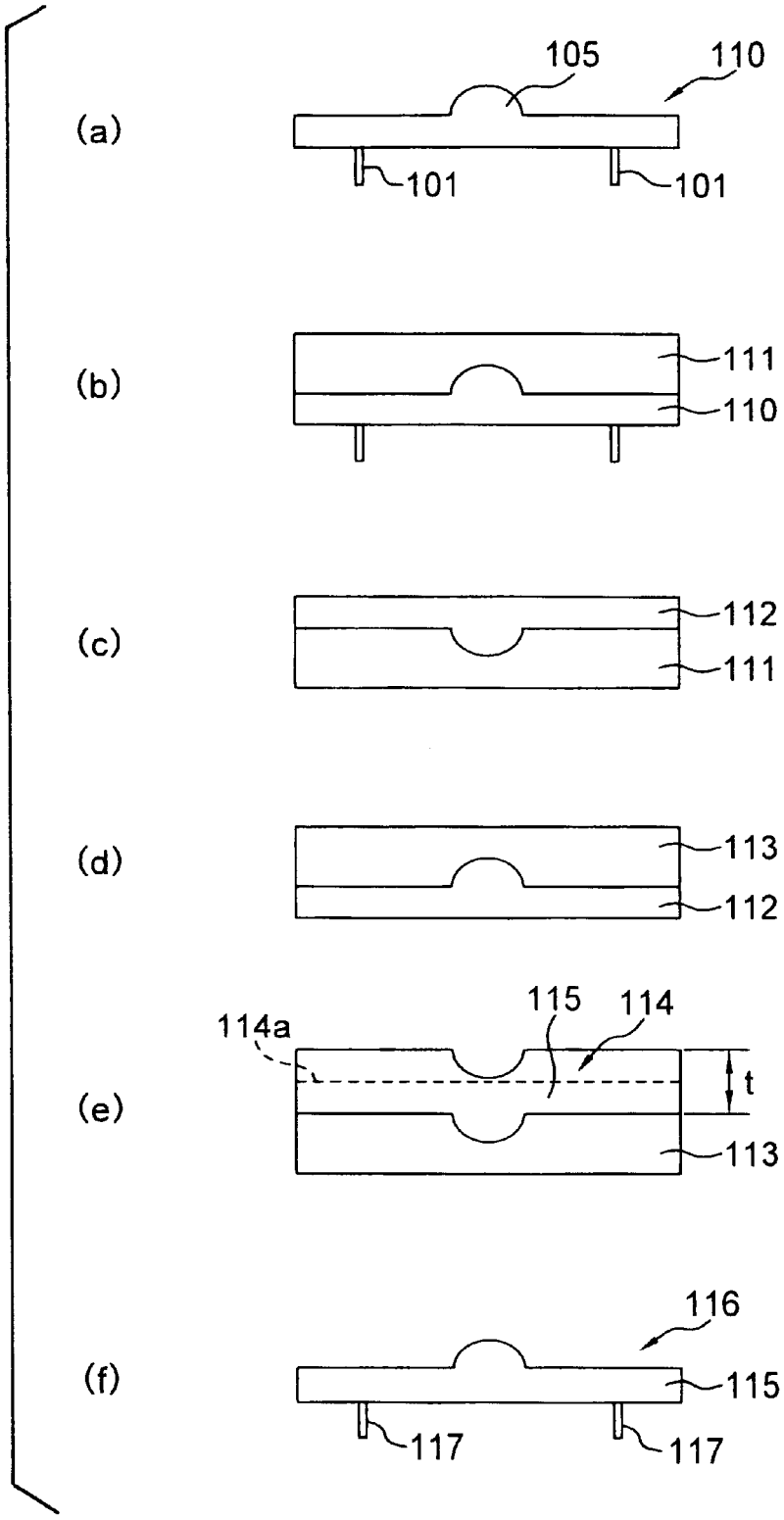
FIGS. 12(*a*) to 12(*f*) are views of assistance in explaining a conventional timepiece dial plate manufacturing method.

Time piece dial plates 30 as shown in FIG. 9(*f*) are manufactured by using the plastic patterns 34 by an electroforming method. As shown in FIG. 9(*e*), the lower plate 11 is formed by an electroforming method using the plastic pattern 34. The lower plate 11 is formed in a very small thickness as compared with the thickness of the electroformed member 114 shown in FIG. 12(*e*) of the conventional timepiece dial plate. The hour markers 12 formed on the lower plate 11 are hollow and the back surfaces thereof are concave. The two holes 13 for receiving the positioning legs 3 therethrough are formed in the lower plate 11. The upper plate 1 is made by press working. The upper plate 1 is provided with the holes 2, and the positioning legs 3 are welded or brazed to the lower surface of the upper plate 1.

Then, as shown in FIG. 9(*f*), the upper plate 1 and the lower plate are superposed and bonded together with the hour markers 12 fitted in the holes 2 of the upper plate 1 so as to protrude from the upper surface of the upper plate 1 and the positioning legs 3 of the upper plate 1 extended through the holes 12.

As is apparent from the foregoing description, according to the present invention, the timepiece dial plate comprises the upper plate 1 and the lower plate 11, the hour markers 12 having surfaces of complicated shapes are formed integrally with the lower plate 11, the positioning legs 3 are attached to the upper plate 1, and the functionally necessary rigidity and strength of the timepiece dial plate are secured by the upper plate 11. Therefore, the upper plate 1 and the lower plate 11 can be manufactured without difficulty, and the hour markers 12 respectively having surfaces of desired, complicated shapes and fully luxurious appearance can easily be formed. The lower plate 11 is required only to provide the hour markers 12 respectively having surfaces of complicated shapes and need not secure rigidity and strength for the timepiece dial plate. Therefore, the lower plate 11 may be very thin. Accordingly, the lower plate 11 can be formed by an electroforming process in a very short time as compared with a time necessary for forming the electroformed member 114 of the conventional timepiece dial plate. The lower plate 11 may be formed by a method other than the electroforming method, such as a press working method or a molding method. Although the lower plate 11 provided with the hour markers 12 has been described by way of example, the indices of the lower plate 11 includes other markers, such as a name marker and the like.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A timepiece dial plate comprising:

an upper plate provided with holes, and positioning legs projecting from its lower surface so as to position the upper plate relative to a movement; and a lower plate provided on its upper surface with solid indices to be fitted in the holes of the upper plate so as to protrude from an upper surface of the upper plate, and provided with holes through which the positioning legs of the upper plate are extended;

wherein the upper plate and the lower plate are superposed so that the solid indices of the lower plate are fitted in the holes of the upper plate, respectively, and protrude from the upper surface of the upper plate, and the positioning legs of the upper plate extend through the holes of the lower plate, respectively.

2. The timepiece dial plate according to claim 1, the upper plate has a thickness greater than that of the main part of the lower plate.

3. The timepiece dial plate according to claim 1, wherein the indices are formed integrally with a main part of the lower plate.

4. The timepiece dial plate according to claim 1, wherein the lower plate has a flat lower surface, the upper plate has a flat upper surface.

5. The timepiece dial plate according to claim 1, wherein both the upper and the lower surface of the upper plate are flat.

6. The timepiece dial plate according to claim 1, wherein the indices are hollow and have concave back surfaces.

7. The timepiece dial plate according to claim 2, wherein the upper plate has a thickness at least twice as great as that of a main part of the lower plate.

8. A timepiece dial plate manufacturing method comprising the steps of:

forming an upper plate provided with holes and positioning legs projecting from its lower surface to position the upper plate relative to a movement;

forming a lower plate provided on its upper surface with solid indices to be fitted in the holes of the upper plate so as to protrude from an upper surface of the upper plate, and provided with holes through which the positioning legs of the upper plate are extended; and superposing the upper plate and the lower plate so that the solid indices of the lower plate are fitted in the holes of the upper plate, respectively, and protrude from the upper surface of the upper plate, and the positioning legs of the upper plate extend through the holes of the lower plate, respectively.

9. The timepiece dial plate manufacturing method according to claim 8, wherein the lower plate is formed by using a pattern having on it surface with protrusions corresponding to the indices and provided with holes corresponding to the holes through which the positioning legs are extended.

10. The timepiece dial plate manufacturing method according to claim 8, wherein the lower plate is formed by an electroforming process using a pattern having on it surface with protrusions corresponding to the indices and provided with holes corresponding to the holes through which the positioning legs are extended.

11. The timepiece dial plate manufacturing method according to claim 8, wherein the indices are formed integrally with a main part of the lower plate.

12. The timepiece dial plate manufacturing method according to claim 8, wherein the lower plate has a flat lower surface, and the upper plate has a flat upper surface.

13. The timepiece dial plate manufacturing method according to claim 8, wherein both the upper and the lower surface of the upper plate are flat.

14. The timepiece dial plate manufacturing method according to claim 8, wherein regions of the lower surface of the lower plate corresponding to the indices are concave.

15. The timepiece dial plate manufacturing method according to claim 8, wherein the upper plate has a thickness greater than that of the main part of the lower plate.

16. The timepiece dial plate manufacturing method according to claim 8, wherein the upper plate has a thickness at least twice as great as that of a main part of the lower plate.

17. The timepiece dial plate manufacturing method according to claim 8, wherein the lower plate is formed by an electroforming method.

* * * * *